US007416018B2

(12) United States Patent
Thunwall et al.

(10) Patent No.: US 7,416,018 B2
(45) Date of Patent: Aug. 26, 2008

(54) ARRANGEMENT FOR A PLATE HEAT EXCHANGER

(75) Inventors: Peter Thunwall, Soderkoping (SE); Hakan Nilsson, Linkoping (SE); Lennart Danielsson, Ljungsburo (SE)

(73) Assignee: Valeo Engine Cooling AB, Solvesborg (SE)

( * ) Notice: Subject to any disclaimer, the term of this patent is extended or adjusted under 35 U.S.C. 154(b) by 97 days.

(21) Appl. No.: 10/528,038

(22) PCT Filed: Sep. 17, 2003

(86) PCT No.: PCT/EP03/10417

§ 371 (c)(1),
(2), (4) Date: Sep. 6, 2005

(87) PCT Pub. No.: WO2004/027334

PCT Pub. Date: Apr. 1, 2004

(65) Prior Publication Data

US 2005/0284620 A1 Dec. 29, 2005

(30) Foreign Application Priority Data

Sep. 17, 2002 (SE) ..... 0202747

(51) Int. Cl.
*F28F 9/013* (2006.01)
*F28F 3/08* (2006.01)

(52) U.S. Cl. ..... 165/67; 165/78; 165/167; 165/178

(58) Field of Classification Search ..... 165/78, 165/166, 167, 916, 67, 178
See application file for complete search history.

(56) References Cited

U.S. PATENT DOCUMENTS 2,193,405 A * 3/1940 Goodman ..... 165/70
2,392,444 A * 1/1946 Amand et al. ..... 165/150

(Continued)

FOREIGN PATENT DOCUMENTS

EP 232231 A1 * 8/1987 ..... 165/167
SE 462763 8/1990

OTHER PUBLICATIONS

English language abstract for SE462763 extracted from espacenet.com database, Jul. 17, 2007.

*Primary Examiner*—Leonard R Leo
(74) *Attorney, Agent, or Firm*—Howard & Howard Attorneys, P.C.

(57) ABSTRACT

The present invention relates to arrangement for a plate heat exchanger for connection to a system, of which the plate heat exchanger is designed to form part. The plate heat exchanger is of conventional construction with plates (2) parallel to one another, which constitute a package (1) and between them define flow channels. The outermost plates (2*a*, 2*b*) of the package (1) are at each short end partially covered by plate elements (6*a*, 6*b*), which essentially lie within the width of the package (1), of which the plate element (6*a*) situated nearest the system has throughholes (7) for assembly elements, which can be inserted into the holes (7) from above, since he pates (2) are formed with recesses (8). At each short end there are also clamping elements which effectively act between the plate elements (6*a*, 6*b*) and are designed to produce a symmetrical clamping force and to hold the package (1) together.

16 Claims, 8 Drawing Sheets

Figure 1A:
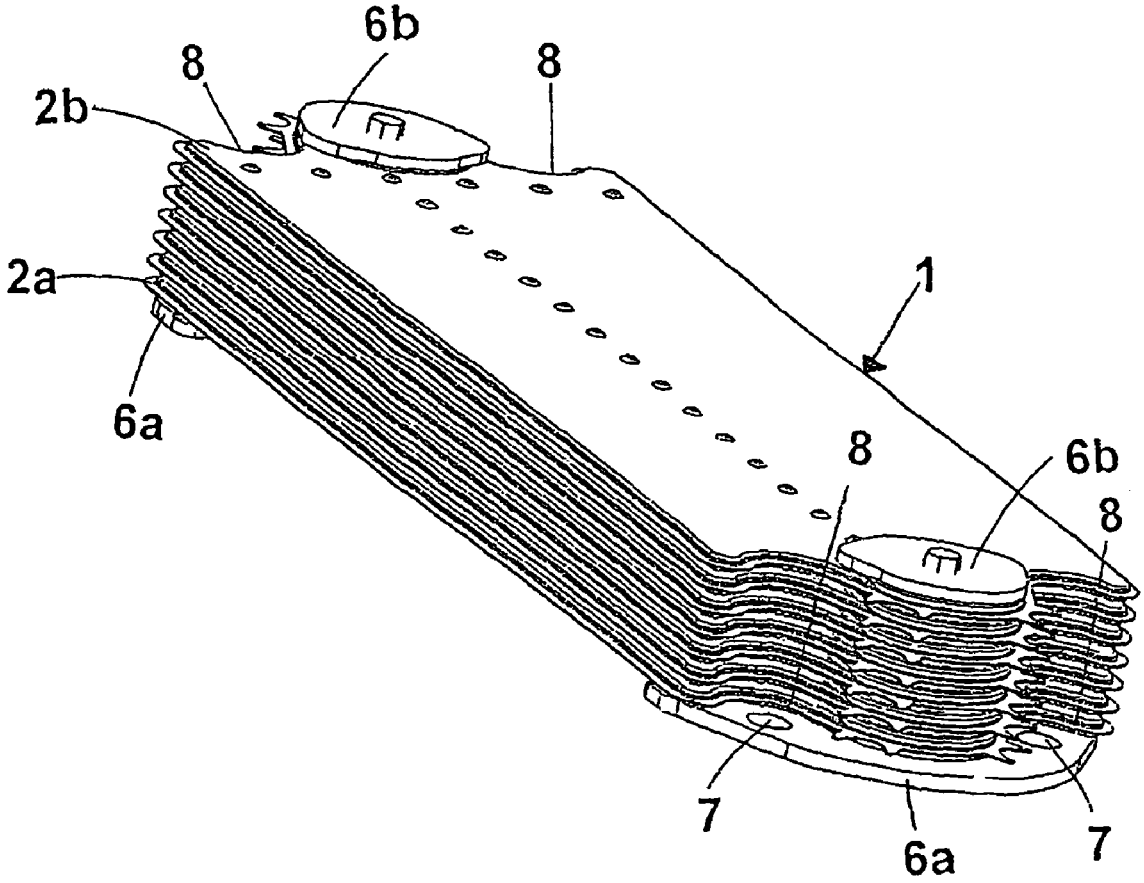

U.S. PATENT DOCUMENTS 2,610,834 A * 9/1952 Dalzell ..... 165/78
2,617,634 A * 11/1952 Jendrassik ..... 165/140
3,444,926 A * 5/1969 Stalberg ..... 165/166
4,263,964 A * 4/1981 Masai et al. ..... 165/67
4,781,248 A * 11/1988 Pfeiffer ..... 165/167
4,903,758 A * 2/1990 Cowan ..... 165/111
5,063,995 A * 11/1991 Forster et al. ..... 165/166
5,165,468 A * 11/1992 Tajima et al. ..... 165/47
5,184,673 A * 2/1993 Hedman et al. ..... 165/153
5,193,612 A * 3/1993 Stirnkorb ..... 165/167
5,307,869 A * 5/1994 Blomgren ..... 165/167
5,435,383 A * 7/1995 Rajagopal ..... 165/167
5,492,171 A * 2/1996 Kallrot ..... 165/167
5,740,859 A * 4/1998 Finch ..... 165/67
5,992,510 A * 11/1999 Kallrot ..... 165/78
2004/0182541 A1 * 9/2004 Blomgren ..... 165/78

* cited by examiner

ARRANGEMENT FOR A PLATE HEAT EXCHANGER

The present invention relates to an arrangement for a plate heat exchanger.

In many applications it is desirable to provide a plate heat exchanger able to be fitted directly to the system of which said plate heat exchanger is designed to form part. This is the case, for example, where the system is an engine and the plate heat exchanger is an oil cooler.

Allowing the media between which heat is to be exchanged to flow in opposite directions, so-called counter-flow, is known to afford effective cooling of the medium that is to be cooled. A known alternative to counter-flow is so-called cross-flow which, however, results in an inferior exchange of heat.

A plate heat exchanger generally comprises plates stacked one on top of another to form a package together with associated assembly elements. For fitting such a known plate heat exchanger directly to the system of which such a plate heat exchanger is designed to form part it has fixing members, often in the form of fixing lugs or the like, which project outside the package. This means that the plate heat exchanger takes up additional space in addition to that occupied up by the actual package. Moreover, this known type of assembly is not ideal from strength point of view, since vibrations can lead to fatigue failures where the fixing lugs are attached to the plate heat exchanger and elsewhere. An advantage with an assembly of this type is that the short sides in such a plate heat exchanger are exposed so that the counter-flow principle can be utilised in the plate heat exchanger. This is not the case with plate heat exchangers of the type disclosed in SE-B-462 763, for example. This plate heat exchanger is designed to be fitted directly to the system of which the plate heat exchanger is designed to form part. It takes up no space other than that required by the package and moreover has a secure seal between the plate heat exchanger and the system. However, the short sides are closed to the admission of cooling medium and such a plate heat exchanger cannot utilize the counter-flow principle.

A problem therefore exists in providing means for firmly fitting a plate heat exchanger directly to the space in the system of which the plate heat exchanger is designed to form part, whilst maintaining a secure seal between the plate heat exchanger and the system and at the same time providing scope for the plate heat exchanger to utilize the counter-flow principle without the plate heat exchanger taking up substantially more space than that occupied by the package of plates.

The object of the present invention is to provide an arrangement for a plate heat exchanger which can be directly connected to the system of which the plate heat exchanger is designed to form part, which essentially does not take up more space than that occupied by the actual package and at the same time affords scope for the plate heat exchanger to utilize both counter-flow and cross-flow. This object is achieved in an arrangement of the aforementioned type in that the invention has the characteristics of claim 1.

The present invention moreover affords the advantage that a secure seal is created between the plate heat exchanger and the system.

Figure 1B:
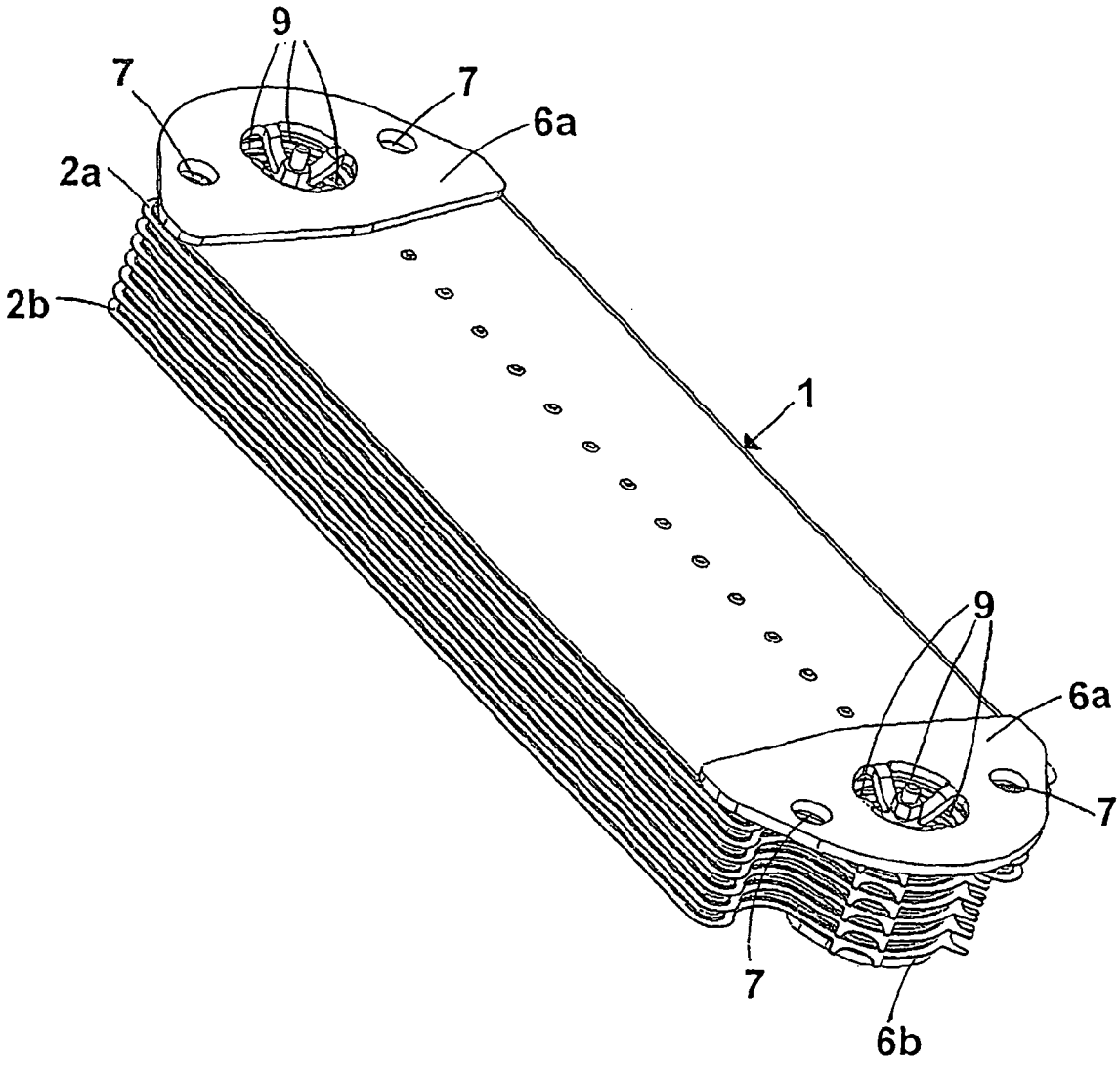
Figure 1C:
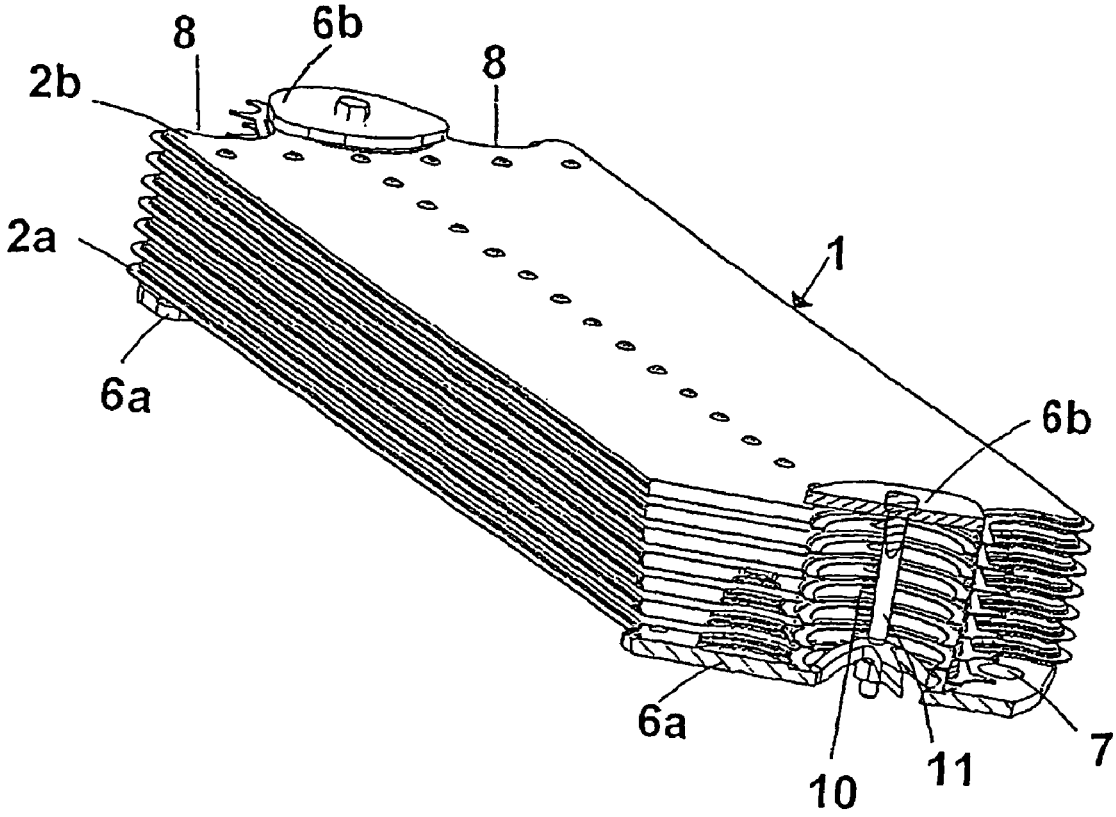
Figure 2A:
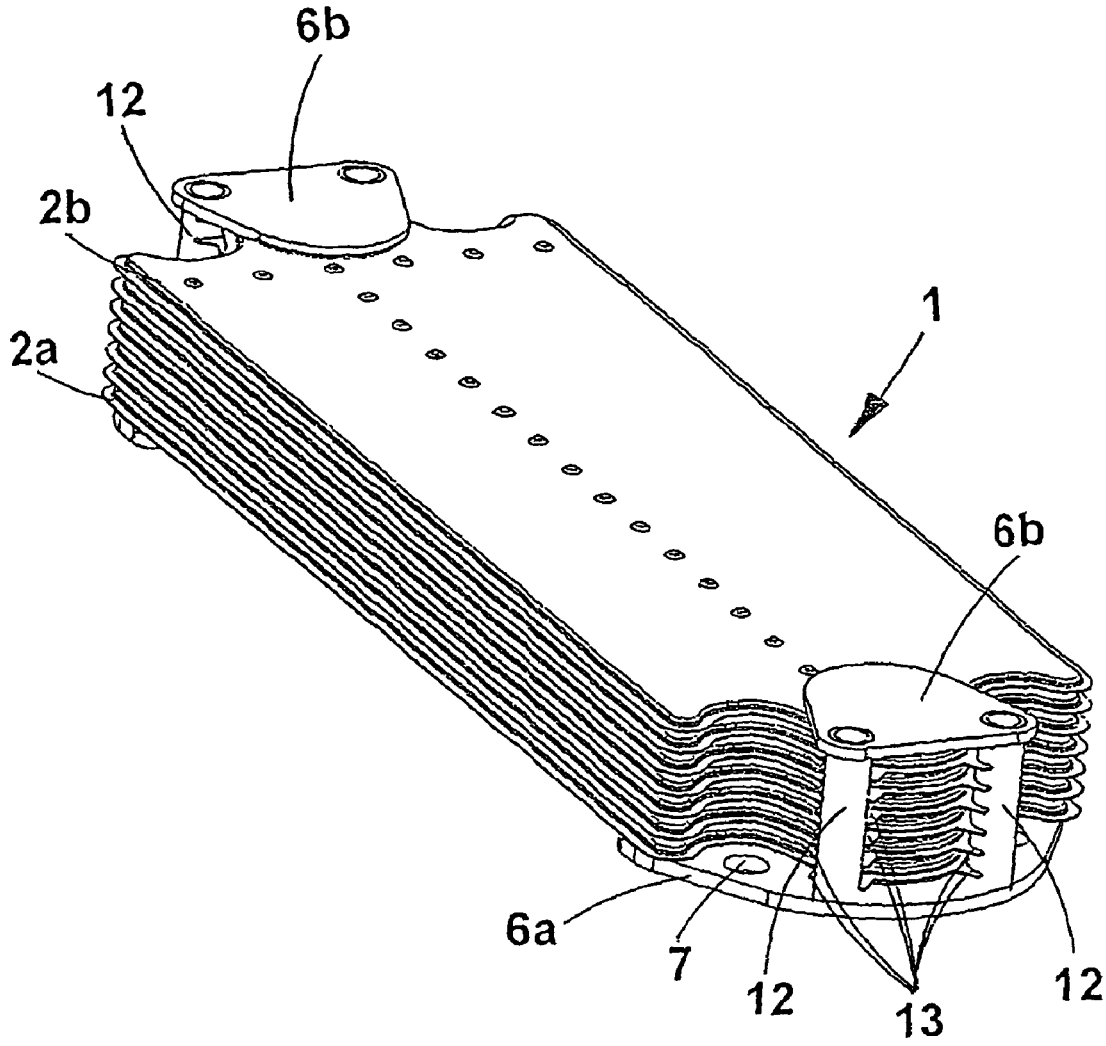
Figure 2B:
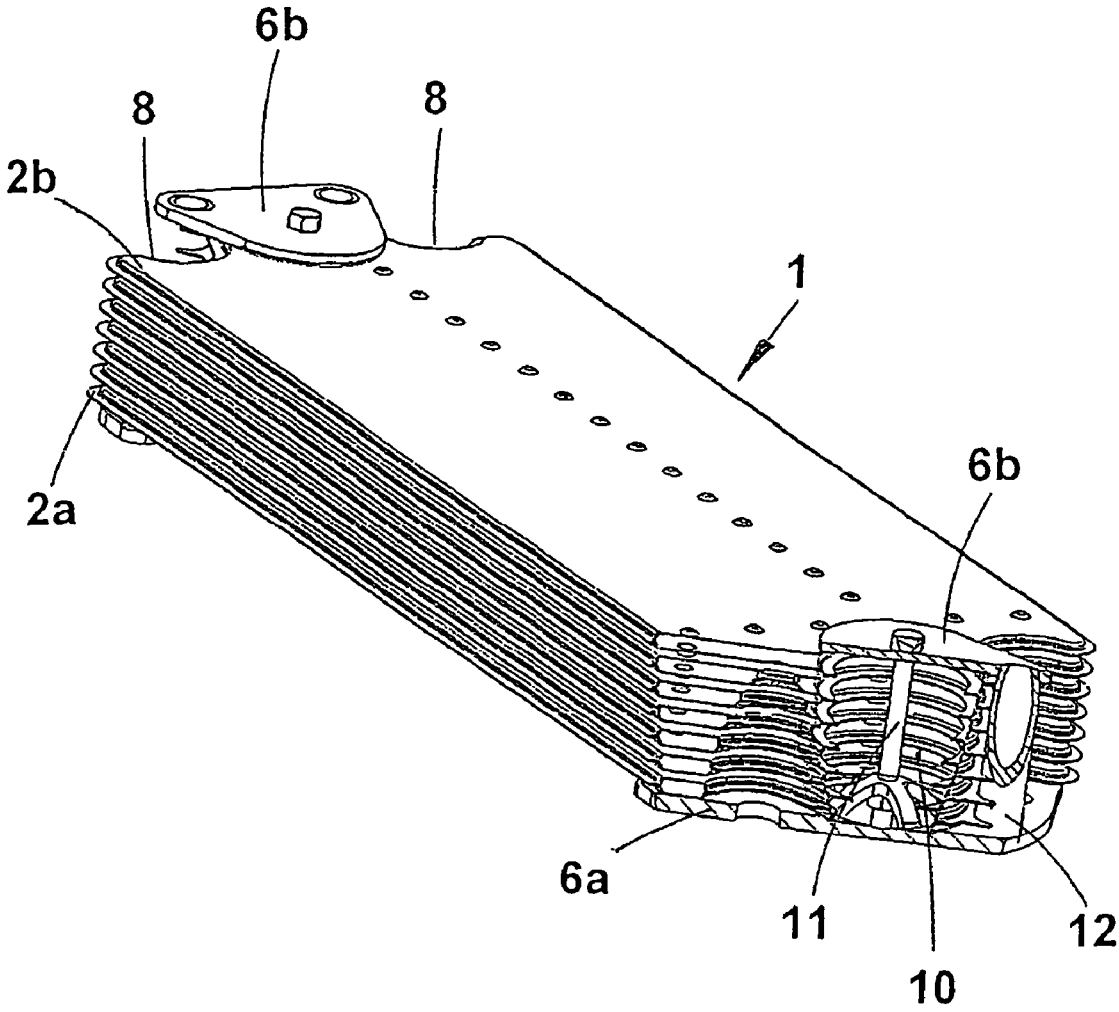
Figure 3A:
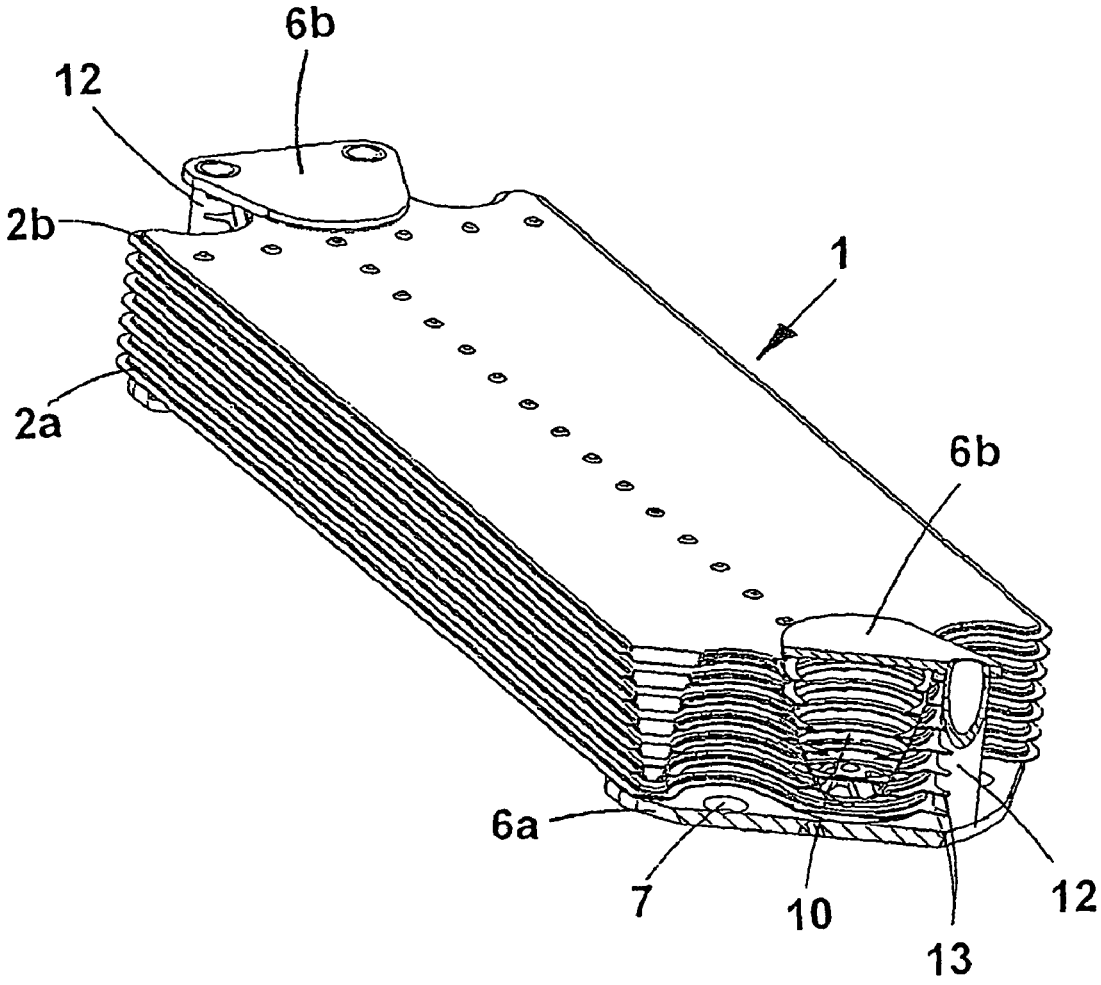
Figure 3B:
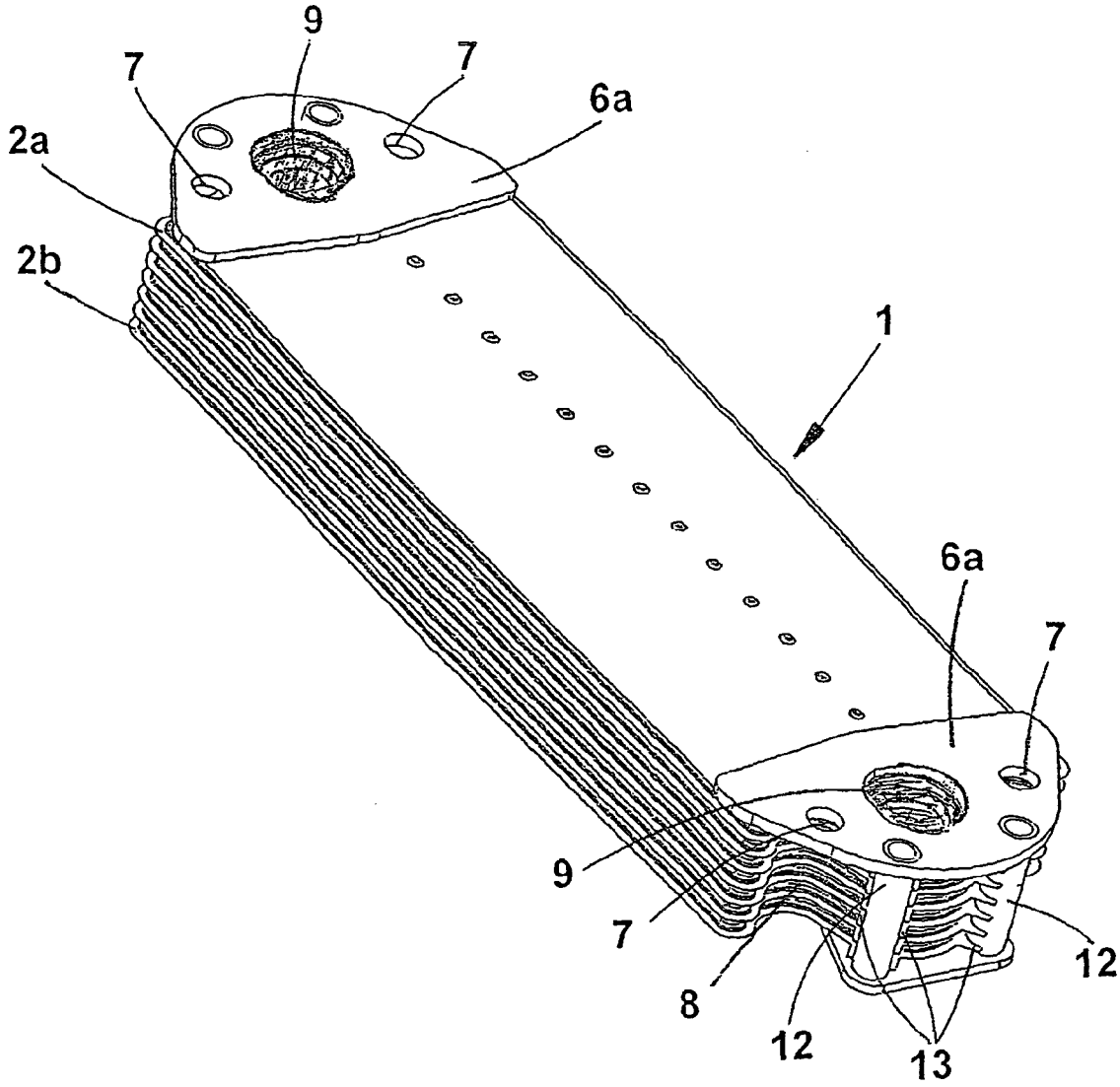

Preferred embodiments of the present invention will be explained in more detail below with reference to the drawing attached, in which FIG. 1*a*-1*c* show schematic diagrams of the preferred embodiment of the invention, of which;

FIG. 1*a* illustrates the plate heat exchanger according to the invention viewed obliquely from above, FIG. 1*b* illustrates the plate heat exchanger in FIG. 1*a* viewed obliquely from below, FIG. 1*c* illustrates the plate heat exchanger in FIG. 1*a* with the short side situated nearest the observer shown partially in section, FIG. 2*a*-2*b* show schematic diagrams of a second embodiment of the plate heat exchanger according to the invention, of which;

FIG. 2*a* illustrates the plate heat exchanger viewed obliquely from above,

FIG. 2*b* illustrates the plate heat exchanger in FIG. 2*a* viewed obliquely from above with the short side situated nearest the observer shown partially in section, FIG. 3*a*-3*b* show schematic diagrams of a third embodiment of the plate heat exchanger according to the invention, of which;

FIG. 3*a* illustrates the plate heat exchanger in FIG. 3*a* viewed obliquely from above with the short side situated nearest the observer shown partially in section and FIG. 3*b* illustrates the plate heat exchanger in FIG. 3*a* viewed obliquely from below.

Figure 4:
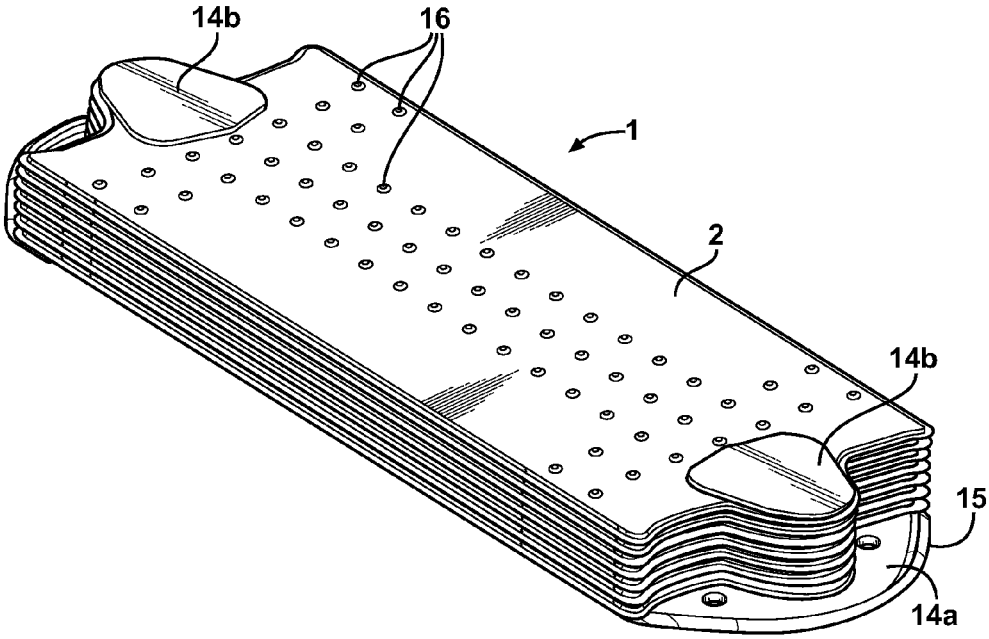

FIG. 4 illustrates a fourth embodiment of the plate heat exchanger according to the invention.

In FIG. 1*a*, 1 generally denotes an elongated package of plates 2, which is constructed conventionally in a manner known in the art with plates 2 parallel to one another, which between them define channels, every second one of which is intended to carry a flow of cooling medium and the other channels of which are intended to carry a flow of heat-emitting medium.

At each short end of the package the outermost plates 2*a*, 2*b* are formed with generally flat plate elements 6*a*, 6*b*, which for the most part lie within the width of the package. The plate element 6*a*, which when assembled is situated nearest to the system of which the plate heat exchanger is designed to form part, has through-holes 7 for connecting the package 1 by means of suitable assembly elements to the space in the system. For this purpose the package is formed with recesses 8, so that the assembly elements can be inserted into the holes 7 from above.

FIG. 1*b* shows through-holes 9 in the plate element 6*a*. Together, these holes 9 form an opening in each plate element 6*a*, for collecting channels 10 in the package 1, see FIG. 1*c*, which connect to the channels in the package 1 and are designed to carry a flow of the heat-emitting medium.

At each short end there is a clamping element 11, which effectively acts between the plate elements 6*a*, 6*b* and runs along the central axis of the collecting channel 10. The clamping element 11 is designed to produce a symmetrical clamping force and to hold the package 1 together, and is designed to counteract the pressure which, when the plate heat exchanger is in use, acts on the plate element 6*b*.

According to a second embodiment of the present invention, which is shown in FIG. 2*a*-2*b*, further clamping elements 12 are arranged laterally inverted around a centre line, so that the clamping element 11 at the top and the clamping element 12 hold the package 1 together with a symmetrical clamping force. The plates 2 are furthermore provided with projections 13, which are directly above one another when the plates 2 are stacked one on top of another in the package 1. The projections 13 partially enclose the clamping elements 12 in pairs, that is to say projections 13 are fitted on either side of the clamping element 12. This means that the clamping elements 12 are also designed to guide the plates 2, so that when stacking in the package 1 they are fitted directly over one another and are not able to slip in relation to one another.

According to a third embodiment in FIG. 3*a*-3*b*, the clamping elements 12 alone produce the symmetrical clamping force. In this embodiment, therefore, it is possible for just one through-hole 9 in each plate element 6*a* to form an opening to the collecting channels 10. It will be appreciated, however, that in this embodiment it is also possible for the openings to consist of a plurality of through-holes 9, as in the embodiments described previously.

In a preferred embodiment the clamping element 11 is a bolt with a nut. In an alternative to this the clamping element consists of a tie rod, which is clinched and soldered after fitting in the package 1. In a preferred embodiment the clamping elements 12 are tubes but in alternative embodiments they may consist of rods or bolts with nuts.

In a preferred application of the present invention the plate heat exchanger consists of an oil cooler and the system consists of an engine, the cooling medium being the coolant and the medium to be cooled being oil. In this application of the plate heat exchanger, the package 1 is fitted inside a casing on the engine block, suitable assembly elements, for example bolts and nuts, being inserted through the holes 7 from above. In applying the present invention according to the preferred embodiment, oil flows from the engine block into the package 1 through one of the two collecting channels 10, flows in the longitudinal direction of the plate heat exchanger, through the channels designed to carry a flow of oil and returns to the engine through the second collecting channel 10.

The package 1 is enclosed in a casing, the interior of which connects with the channels designed to carry a flow of the coolant.

The package 1 is further designed to allow the coolant to flow in at the short end of the package 1, in the collecting channel 10 of which the oil returns to the engine, so that the coolant flows in the opposite direction to the direction of flow of the oil through the channels, which are designed to carry a flow of the coolant, and flows out at the opposite short end of the package 1.

The plate elements 6*a*-*b* and the clamping elements 11-12 are designed to absorb forces acting on the plate heat exchanger during use, so that a secure seal is obtained between the plate heat exchanger and the engine, to which the plate heat exchanger can be directly connected. The plate elements 6*a*-*b* furthermore lie largely within the width of the package, which means that the width of the plate heat exchanger does not take up substantially more space than that occupied by the package, whilst the counter-flow principle can be used for effective heat exchange.

In FIG. 4, the plate elements 14*b* farthest away from the system, corresponding to the plate elements 6*b* in FIGS. 1*a*-3*b*, have been shaped so as to present an extension in a first direction, which is parallel with a main plane of the plate 2*b* of the heat exchanger 1, and with the longitudinal direction of the heat exchanger. The plate elements 14*b* extend from the short edges of the heat exchanger and inwards towards the center of the heat exchanger plate 2*b*.

In addition, the plate 14*b* may be so shaped as to present an extension that, towards the center of the heat exchanger plate 2*b* increases in a second direction, which is parallel with the main plane of the plates 2 of the heat exchanger 1, and perpendicular to the longitudinal direction of the heat exchanger.

This extension of the plate elements provides a reinforcement of the heat exchanger plate 2*b* which is farthest away from the system, so as to reduce that plate's susceptibility of rupture as a consequence of fatigue caused by pressure and/or pressure pulsations inflicted by the oil supply to the collecting channel 10 (FIG. 1*c*).

The size and extension of the plate elements 14*b* of the embodiment illustrated in FIG. 4 is an illustration. In practical embodiments, the reinforcing extension in said first and second directions is chosen based on experience of the heat exchanger, and on rupture testing. Also, when choosing the extension of the plate elements 14*b*, there may be an incentive to keep at least the extension in the second direction to a minimum, so as not to hamper the coolant flow in the longitudinal direction of the plate heat exchanger 1.

The reinforcement may be provided in different manners. In the embodiment illustrated in FIG. 4, the plate elements 14*b* constitute extended versions of the plate elements 6*b* disclosed in FIGS. 1*a*, 1*c*, 2*a*, 2*b* and 3*a*, i.e. the plate element 14*b* is formed as a single component acting both as a lid for the collecting channel 10, and as an abutment for the clamping element 11 (not shown in FIG. 4).

As an alternative (not shown), the reinforcement may be provided in the form of a plate which is sized and shaped so as to connect to the plate element 6*b*, either by an overlap, or by being fitted snugly against the plate element 6*b*.

Common for both alternatives is that the plate elements 6*b*, 14*b* and the reinforcement plate (not shown) may be attached to the heat exchanger plate 2 farthest away from the system by means of soldering.

In one embodiment, the thickness of the reinforcement plate may be chosen to substantially the same as the height of protrusions 16 provided on the face of the heat exchanger plate 2.

In FIG. 4, the plate element 6*a*, 14*a* closest to the system is provided with a folded or reinforced edge 15, so as to reinforce the plate element 6*a*, 14*a*, and to prevent it from bending as a consequence of pressure inflicted by the oil supply to the collecting channel 10 (FIG. 1*c*).

It is understood that the embodiments having the reinforcements according to the different alternatives described above with reference to FIG. 4 may be combined with the different embodiments described with reference to FIGS. 1*a*-3*b*.

The invention claimed is:

1. Arrangement for a plate heat exchanger for connection to a system, comprising;

an elongated package (1) of mutually parallel plates (2) between which channels are defined for a first medium and a second medium, respectively, with the package (1) defining a width and edge portions of the plates (2) defining recesses, the outermost plates (2*a*, 2*b*) of the package (1) have at each of their respective short ends first and second plate elements (6*a*, 6*b*) partially covering each short end, of which only the first plate elements (6*a*) situated nearest the system have mounting through-holes (7) disposed outside of the recesses for assembly of the package (1) by assembly elements and at least one medium through-hole (9) which constitutes an opening to a collecting channel (10) of the package (1) for one of the medium with the plate elements (6*a*, 6*b*) being essentially within the width of the package (1).

2. Arrangement according to claim 1, characterized in that at each short end there is at least one clamping element (11; 12) which effectively acts between the plate elements (6*a*; 6*b*) and which is at least partially enclosed by the package (1) and is designed to produce a symmetrical clamping force.

3. Arrangement according to claim 1 or 2, characterized in that a clamping element (11) runs along the centre axis of each collecting channel (10) and is entirely enclosed by the package (1).

4. Arrangement according to claim 1 or 2, characterized in that there is at least one clamping element (12), which is only partially enclosed by the package (1).

5. Arrangement according to claim 1 or 2, characterized in that there is a clamping element (11), which runs along the centre axis of each collecting channel (10) and is entirely enclosed by the package (1), and at least one clamping element (12), which is only partially enclosed by the package (1).

6. Arrangement according to claim 1, characterized in that the mounting through-holes (7) lie within the width of the package (1).

7. Arrangement according to claim 1, characterized in that one of the plate elements (6*b*, 14*b*), which is arranged farthest away from the system, extends in a first direction, which is parallel with a main plane of one of the outermost plates (2*b*), and with the longitudinal direction of the heat exchanger, such that the plate element (6*b*, 14*b*) provides a reinforcement of the outermost plate (2*b*) in the area near the collecting channel (10), and counteracts rupture or deformation of the plate (2).

8. Arrangement according to claim 2, characterized in that at each short end the clamping element (12) engages both of the first and second plate elements (6*a*, 6*b*) outside the mounting through-holes (7) of the first plate element (6*a*) at the same short end.

9. Arrangement for a plate heat exchanger for connection to a system, comprising;

an elongated package (1) of mutually parallel plates (2) between which channels are defined for a first medium and a second medium, respectively, with the package (1) defining a width and edge portions of the plates (2) defining recesses, the outermost plates (2*a*, 2*b*) of the package (1) have at each of their respective short ends first and second plate elements (6*a*, 6*b*) partially covering each short end, of which the first plate elements (6*a*) have mounting through-holes (7) disposed outside of the recesses for assembly of the package (1) and at least one medium through-hole (9) which constitutes an opening to a collecting channel (10) of the package (1) for one of the medium, and at least one clamping element (11; 12) at each short end engaging both the first and second plate elements (6*a*, 6*b*) outside of the mounting through-holes (7) for effectively acting between the plate elements (6*a*; 6*b*) and being at least partially enclosed by the package (1) to produce a symmetrical clamping force.

10. Arrangement according to claim 9, characterized in that the plate elements (6*a*, 6*b*) are essentially within the width of the package (1).

11. Arrangement according to claim 10, characterized in that the mounting through-holes (7) lie within the width of the package (1).

12. Arrangement according to claim 9, characterized in that the clamping element (11) runs along a centre axis of each collecting channel (10) within the medium through-hole (9) and is entirely enclosed by the package (1).

13. Arrangement according to claim 9, characterized in that there is at least one clamping element (12), which is only partially enclosed by the package (1).

14. Arrangement according to claim 9, characterized in that there is a clamping element (11), which runs along the centre axis of each collecting channel (10) within the medium through-hole (9) and is entirely enclosed by the package (1), and at least one clamping element (12), which is only partially enclosed by the package (1).

15. Arrangement according to claim 9, characterized in that the mounting (7) and medium (9) through-holes are only disposed in the first plate elements (6*a*).

16. Arrangement according to claim 9, characterized in that there are assembly elements disposed through the mounting through-holes (7) for assembly of the package (1) to the system.

* * * * *